United States Patent [19]

Alimbau Marques et al.

[11] Patent Number: 4,519,476

[45] Date of Patent: May 28, 1985

[54] DETACHABLE WORKBENCH TOP

[75] Inventors: Salvador Alimbau Marques, Barcelona, Spain; Giorgio Grasselli, Albinea, Italy

[73] Assignee: Andral Corporation, Williamsville, N.Y.

[21] Appl. No.: 614,625

[22] Filed: May 29, 1984

Related U.S. Application Data

[63] Continuation-in-part of Ser. No. 492,487, May 6, 1983, Pat. No. 4,448,283, which is a continuation-in-part of Ser. No. 537,276, Sep. 29, 1983.

[51] Int. Cl.[3] ..... E04G 1/30; E06C 7/16; E06C 1/383

[52] U.S. Cl. ..... 182/28; 182/27; 182/35; 182/151; 182/164

[58] Field of Search ..... 182/27, 28, 32, 35, 182/151, 152, 163, 164

[56] References Cited

U.S. PATENT DOCUMENTS

| | | | |
|---|---|---|---|
| 476,897 | 6/1892 | Ripp | 182/27 |
| 513,012 | 1/1894 | Hall | 182/27 |
| 575,397 | 1/1897 | Hilliker | 182/27 |
| 738,998 | 9/1903 | Heath | 182/28 |
| 3,241,633 | 3/1966 | Bond | 182/28 |
| 3,452,838 | 7/1969 | Gabrielson | 182/28 |
| 4,429,766 | 2/1984 | Marques | 182/195 |
| 4,448,283 | 5/1984 | Marques | 182/164 |
| 4,457,391 | 7/1984 | Marques | 182/164 |

*Primary Examiner*—Reinaldo P. Machado
*Attorney, Agent, or Firm*—James J. Ralabate

[57] ABSTRACT

This invention relates to a detachable top to be used with foldup ladders of the type described in co-pending applications Ser. Nos. 06/341,830; 06/492,487; and 06/537,276. Also, this top can be used with the slidable ladder described in U.S. Pat. No. 4,429,766. This ladder can be converted into many structures such as a workbench, table or step ladder. The top comprises a rectangular main portion and a narrower extending section. The main portion fits over and around the rails of the ladder (after conversion to a workbench) and the narrower extending section fits inside the rails but on substantially the same plane as the main portion.

19 Claims, 5 Drawing Figures

DETACHABLE WORKBENCH TOP

This application is a continuation-in-part of U.S. patent application Ser. No. 06/492,487 filed May 6, 1983 and now U.S. Pat. No. 4,448,283 which is a continuation-in-part of Ser. No. 06/537,276 filed Sept. 29, 1983.

This application relates to a detachable worktop adapted for use with a workbench over which it fits.

BACKGROUND OF THE INVENTION

In U.S. applications Ser. No. 06/341,830 filed Jan. 22, 1982; Ser. No. 06/417,382 filed Sept. 13, 1982 (now U.S. Pat. No. 4,429,766); Ser. No. 06/492,487 filed May 6, 1983; and Ser. No. 06/537,276 filed Sept. 29, 1983 convertible ladders are disclosed and claimed. Each of these ladders are made up of U-shaped modules that are connected to each other by hinges that permit each module when not in use to fold or slide within its adjacent wider module. Each of these ladders has locking mechanisms that permit the modules to lock securely to each other when the ladder is in the extended or raised position.

In all the above-noted patent applications with the exception of Ser. No. 06/417,382, the U-shaped hinged modules are adpated to fold into their next wider modules when compacted for storage or to be transported. Since each hinged module will rotate 360° on its hinged axis, many variations can be accomplished such as step ladders, workbenches, etc. In Ser. No. 06/537,276 a ladder conversion to a workbench is disclosed and illustrated in FIG. 6. This workbench is formed from the folding ladder merely by folding down the second (from bottom) and fifth (from bottom) modules. These modules are then locked in place and supported by brackets 32 in at least two corners. These brackets generally take the form of metal or plastic bars that have a projection on one end and an aperture on the opposite end. When this structure is to be used as a workbench it is highly desirable to have a working surface on which to work.

SUMMARY OF THIS INVENTION

It is therefore an object of this invention to provide a removable workbench top adapted for use with the above-described ladders.

It is another object of this invention to provide a detachable top that can also be used with the ladder structure as a table.

Another object of this invention is to provide a convenient case or container for the ladder when the ladder is compacted for storage.

Still another object of this invention is to provide a solid top for the above-noted ladders that can be used to stand on when painting, papering, or otherwise working when a flat raised surface is required.

Another still further object of this invention is to provide a secondary container into which the ladder can be fitted and packed before shipping or storage.

Yet still a further object of this invention is to provide a workbench top that can accommodate bracket storage for the ladder when the ladder is not in use.

The foregoing objects and others are accomplished by this invention generally speaking by providing a detachable workbench top having dimensions slightly exceeding the outer periphery of the supporting structure. The ladders earlier mentioned comprise modules of vertical side rails and horizontal rungs. The workbench top of this invention has dimensions that slightly exceed the widest or bottom module. When the ladder is folded or compacted the ladder will fit snugly within the under interior portion of this workbench top.

The workbench top is of a rectangular structure or configuration having integral therewith a rectangular (or other shaped) extending section. Positioned between the main rectangular structure and the rectangular (or other shaped) extending section are cutout portions to accommodate the side rails or rungs of the supporting structure (ladder). The main rectangular structure fits around and encloses the outer periphery of the rails of supporting structure while the extending section fits inside the rails. The extending section preferrably contains a pocket portion for holding nails, screws, tools or other objects used while working. This pocket portion is structured so that the longitudinal side is spaced from the outer edge of the extending section just slightly more than the width of the brackets. Thus when stored, the ladder and brackets both can be housed within the framework of the detachable top. The brackets will fit tightly just above the recessed pocket along its upper longitudinal side and the ladder will abut and fit tightly against the lower longitudinal side of the pocket.

The detachable top of this invention can be made from metal such as aluminum, steel, alloys, or wood, or plastics such as nylon, Teflon, P.V.C., polystyrene materials, polyurethanes, polycarbonates, or fiberglass or any other suitable material. It is important that the materials be of high impact strength and be durable enough to permit the user to stand on it or exert pressure on it without any structural failure.

DESCRIPTION OF DRAWING AND PREFERRED EMBODIMENTS OF THIS INVENTION

Figure 1:
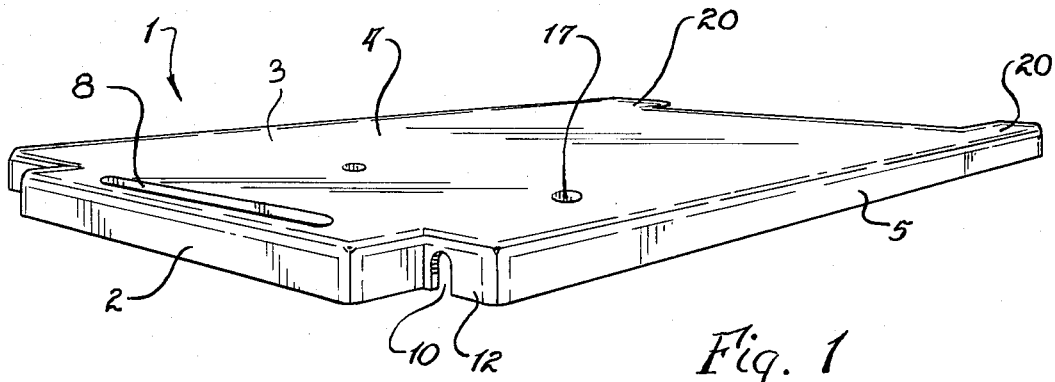
FIG. 1 is a view in top elevation of the detachable top of this invention.

In FIG. 1, tabletop or workbench top 1 is shown in top elevational view. The top is substantially rectangular with an extending section 2 that is not as wide as the width of main rectangular structure 3. The top 1 has a top portion 4, and side walls or lips 5 which are approximately the same height around the complete periphery of top 1. These side walls 5 fit tightly around and encompass the rails 6 of the supporting structure or workbench 7. The dimensions of the main rectangular portion of detachable top 1 are just slightly greater than the dimensions of the upper peripheral portion of workbench 7. In the extending section 2 of the top 1 is positioned a depressed pocket 8 which can be used for screws, nails, bolts, tools or other items needed when working with the workbench 7. Extending section 2 may be of any configuration or shape but preferrably it is rectangular so that it fits snugly within rails 9 as shown in FIG. 4.

Figure 2:
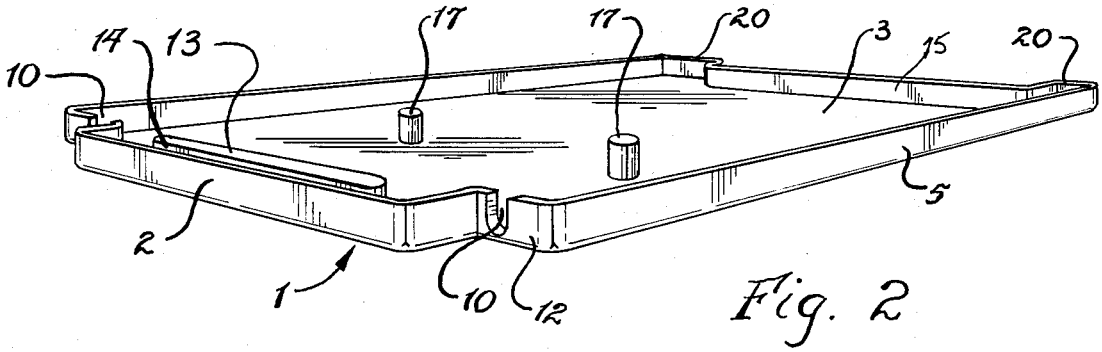
FIG. 2 is a view in bottom elevation of the detachable top of this invention.
Figure 5:
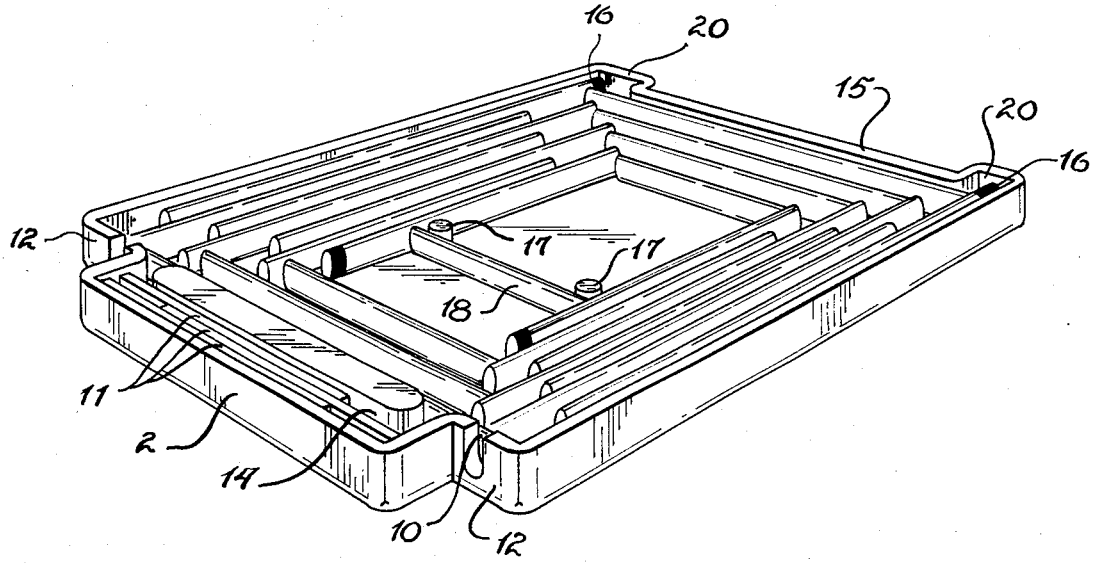
FIG. 5 is a view in bottom elevation of the ladder (or workbench) when it is folded and fitted within the bottom portion of the workbench top of this invention.

In FIG. 2 tabletop 1 is turned over so that the bottom portion is shown in bottom perspective. The walls 5 completely encircle the periphery of tabletop 1 and because of its tight fit on all four sides, tabletop 1 is held firmly in position. Cutout portions 10 permit the tabletop 1 to fit tightly around the rails 9 and brackets 11. Cutout portions 10 are located immediately adjacent the extending section 2 terminal portions and the recessed portions 12 of the tabletop 1. The bottom surface 13 of pocket 8 performs a dual function. First, it holds items in pocket 8 and forms a side of bracket compartment 14. Brackets 11 when not in use are stored in compartment 14 (as shown in FIG. 5). The inner bottom side 15 of walls 5 fit tightly against the leg portions 16 of ladder or workbench 7. It is preferred that this bottom inside wall 15 be fluted as shown in the drawings to more securely hold the leg portions 16 in position. Also, it is preferred to locate projections or nipples 17 at the bottom surface of tabletop 1 in order to better support the ladder when in a storage mode as shown in FIG. 5. Projections 17 abut and hold rail or rung 18 when the ladder or workbench 7 is contained within top 1. A fluted portion 20 is located at the bottom side of top 1 to accommodate the legs of the ladder or supporting structure when it is in a folded or stored mode and is contained therein for shipping or storage.

Figure 3:
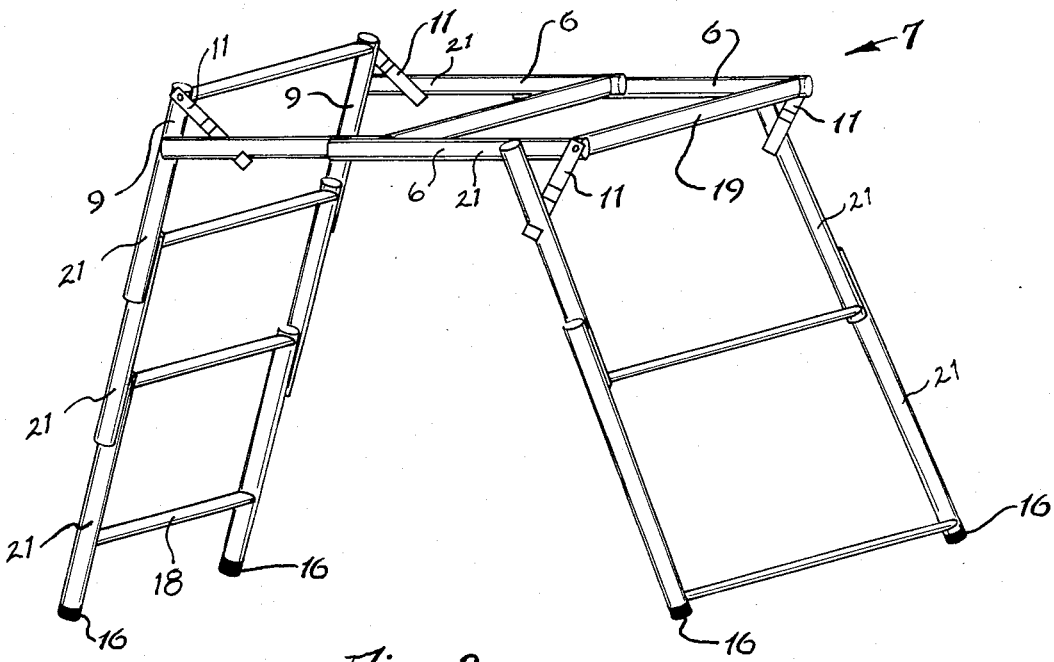
FIG. 3 is a side perspective view of the workbench (converted ladder) before the workbench top of this invention is used with it.

In FIG. 3 the ladder 7 is shown as it is converted into a workbench or table 7. Brackets 11 are placed at diagonal corners for best support. However, they can be used in all four corners if desired. Side rails 6 around which the tabletop 1 of this invention fits provide the outer longitudinal skeleton structure for the workbench top surface. The tabletop 1 therefore fits over and around the top portion of side rails 6 and rung 19 which forms the periphery of the top structure of workbench 7.

Figure 4:
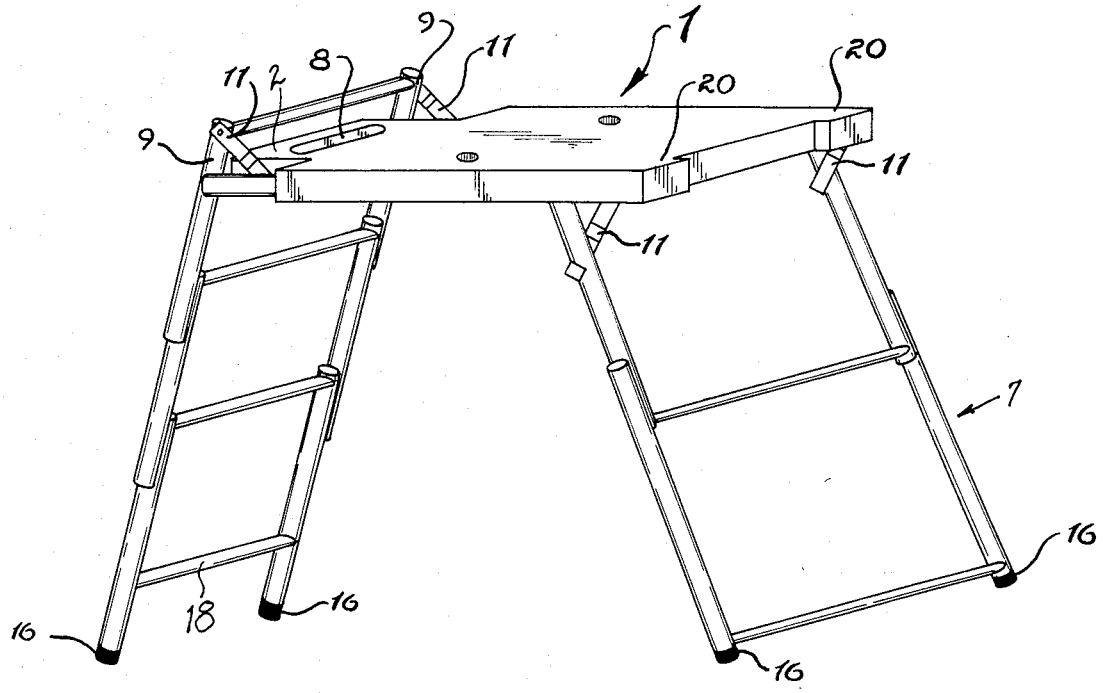
FIG. 4 is a side perspective view of the workbench (converted ladder) after the workbench top is attached onto its upper surface.

FIG. 4 illustrates the workbench 7 with the tabletop 1 of this invention attached thereto. Side walls 5 completely tightly encircle the rung 19 and side rails 6 which form the upper surface of workbench 7. Because of the snug fit, tabletop 1 is firmly held in position and will not slip. Additional security is provided by cutout sections 10 which fit around brackets 11 and/or side rails to lock the top 1 in position. Pocket 8 is shown located in extending section 2 as it fits between narrower side rails 9. Brackets 11 are clearly illustrated in position on diagonal corners of the workbench 7.

FIG. 5 shows the ladder or workbench 7 when its rails and rungs (which make up the modules 21 of the ladder or structure of this invention) are folded and positioned within tabletop 1 for storage, shipping, or protection. Brackets 11 are stored in the upper compartment 14 and contact pocket upper side walls. The ladder 7 contacts pocket lower side walls and is held firmly in position both here and in other locations around its periphery. Legs 16 are firmly in contact with the inner walls 15 of tabletop 1 and because of the somewhat resilient nature of the material (polystyrene materials preferred) from which top 1 is constructed, a spring-like locking action is exerted. Thus, when folded, ladder 7 is tightly fitted within top 1, the resilient nature of the top 1 will firmly grip and hold the ladder in position. If metal is used to make the tabletop a somewhat less resilient locking action is exerted, however, there will be some because of the end rubber portions of legs 16. Rail 18 or rung 18 fits across projections 17 to provide an extra holding action to prevent sliding of the ladder when in shipping or transit. It is desirable to have at least one projection 17 or any shape structure that is in the bottom surface of the top 1 and extends downward therefrom. This could be in the form of a bar extending across a portion of or the entire width of the bottom of detachable top 1. It could also be integral with top 1 or detachable therefrom. Thus, it can be snapped into bottom of top 1 when required for shipping and the like and removed when top 1 is in use.

Additionally, a worktop similar to that described above can be used when the ladder or support is used as shown in FIG. 3B of co-pending application Ser. No. 600,804. That is when one module of the ladder is folded down to provide a work surface for the lean-to ladder. Brackets 11 are used to support this work surface formed by the folded down module. The worktop then merely rests upon the folded down module and provides a surface on which a paint can, tools or other objects can rest. This worktop can have a depressed pocket into which paint can be poured to be used with a paint roller, brush or pad. The pocket can have vertical walls or slanted or inclined walls to accommodate the use of rollers or pads. This worktop can merely fit into the depression of the module or can fit over the side rails of the module for additional strength.

The preferred and optimumly preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A detachable top adapted for use with a supporting structure comprising a substantially rectangular main portion having an extending section protruding therefrom, said extending section having a width less than that of said main rectangular portion and adjacent to and integral with one side of said main portion, a side wall extending downward from substantially the entire peripheral portion of said main rectangular portion and said extending section, and a cutout area located between said main portion and said extending section.

2. The detachable top of claim 1 wherein said cutout area is located in said side wall.

3. The detachable top of claim 1 wherein said main portion has a recessed portion on either side of said extending section, and wherein said cutout area is located.

4. The detachable top of claim wherein said extending section contains a pocket which is depressed downwardly from the upper surface of said detachable top.

5. The detachable top of claim 1 wherein said side wall of said main portion is adapted to fit over the outer periphery of said supporting structure and wherein said side wall of said extending section is adapted to fit adjacent of the inner periphery of said same supporting structure.

6. The detachable top of claim 1 wherein said main portion has at least one projection extending downward beyond the upper surface of said detachable top.

7. The detachable top of claim 1 wherein said main portion contains two fluted sections to accommodate the leg portions of said supporting structure when said structure is folded within said detachable top.

8. A detachable top adapted for use with a supporting structure comprising a substantially rectangular main portion having extending from one side thereof an extending section, a recessed portion of said main portion located adjacent said extending section and integral therewith, a cutout area located on each side of said recessed portion thereby defining two openings to accommodate brackets used with said supporting structure, said main portion and said extending section having a side wall extending downward from substantially the entire peripheral portion of said detachable top, the main portion part of said side wall adapted to fit over said supporting structure and the extending section part of said side wall adapted to fit inside the terminal portions of said supporting structure, and a pocket located in and extending downward from said extending section.

9. The detachable top of claim 8 wherein said cutout area is located in said side wall.

10. The detachable top of claim 8 wherein said side wall of said main portion is adapted to fit over the outer periphery of said supporting structure and wherein said side wall of said extending section is adapted to fit adjacent of the inner periphery of said same supporting structure.

11. The detachable top of claim 8 wherein said main portion has at least one projection extending downward beyond the upper surface of said detachable top.

12. The detachable top of claim 8 wherein said main portion contains two fluted sections to accommodate the leg portions of said supporting structure when said structure is folded within said detachable top.

13. The detachable top of claim 8 made from a high impact polystyrene material.

14. The detachable top of claim 8 made from a plastic material.

15. The detachable top of claim 8 made from fiberglass.

16. The detachable top of claim 8 made from a metal.

17. The detachable top of claim 8 made from aluminum.

18. The detachable top of claim 8 made from a wood product.

19. A workbench-table comprising in combination a supporting structure and a detachable top, said supporting structure comprising a series of U-shaped modules which decrease in size as they approach the top of said supporting structure and each movably connected to the other, a hinge positioned in the upper portion of a wider module and in the lower portion of the next adjacent narrower module, said supporting structure folded in such a manner so as to define a workbench-table, said detachable top comprising a substantially rectangular main portion having extending from one side thereof an extending section, said extending section having a width less than that of said main portion and integral with one side of said main portion, and a cutout area located between said main portion and said extending section, said cutout area resting on a portion of said modules to secure said top to said supporting structure.

* * * * *